US007637770B2

(12) United States Patent
Metral

(10) Patent No.: US 7,637,770 B2
(45) Date of Patent: Dec. 29, 2009

(54) CONTACTS OF A TELECOMMUNICATIONS MODULE WITH REDUCED CROSS-TALK

(75) Inventor: Guy Metral, Cluses (FR)

(73) Assignee: 3M Innovative Properties Company, St. Paul, MN (US)

( * ) Notice: Subject to any disclaimer, the term of this patent is extended or adjusted under 35 U.S.C. 154(b) by 124 days.

(21) Appl. No.: 11/913,344

(22) PCT Filed: May 3, 2006

(86) PCT No.: PCT/US2006/017147

§ 371 (c)(1),
(2), (4) Date: Nov. 1, 2007

(87) PCT Pub. No.: WO2006/119427

PCT Pub. Date: Nov. 9, 2006

(65) Prior Publication Data

US 2008/0186684 A1 Aug. 7, 2008

(30) Foreign Application Priority Data

May 3, 2005 (EP) ..... 05009690

(51) Int. Cl.
*H01R 4/24* (2006.01)
*H01R 4/26* (2006.01)
*H01R 11/20* (2006.01)

(52) U.S. Cl. ..... 439/404; 439/405; 439/941

(58) Field of Classification Search ..... 439/404, 439/405, 941
See application file for complete search history.

(56) References Cited

U.S. PATENT DOCUMENTS

| | | | | |
|---|---|---|---|---|
| 4,512,620 | A * | 4/1985 | Tillotson | 439/391 |
| 4,514,030 | A * | 4/1985 | Triner et al. | 439/188 |
| 4,995,828 | A * | 2/1991 | Goodman et al. | 439/405 |
| 5,160,273 | A | 11/1992 | Carney | |
| 5,163,855 | A | 11/1992 | Gerke et al. | |
| 5,326,286 | A * | 7/1994 | Bixler et al. | 439/751 |
| 5,494,461 | A | 2/1996 | Bippus et al. | |
| 5,556,296 | A | 9/1996 | Dussausse et al. | |
| 5,853,303 | A | 12/1998 | Brunker et al. | |
| 5,967,826 | A | 10/1999 | Letailleur | |
| 6,171,134 | B1 * | 1/2001 | Lai | 439/405 |
| 6,386,901 | B1 * | 5/2002 | Caldwell | 439/425 |
| 6,811,429 | B2 * | 11/2004 | Recktenwald et al. | 439/405 |
| 2008/0273690 | A1 * | 11/2008 | Bonvallat et al. | 379/387.01 |

* cited by examiner

*Primary Examiner*—Hae Moon Hyeon
(74) *Attorney, Agent, or Firm*—Gregg H. Rosenblatt

(57) ABSTRACT

Telecommunications modules (10) having contacts (12) adapted generally to connect wires therewith and arranged in at least one row defining a row direction (R), the contacts (12) comprising a length direction (L) extending substantially perpendicular to the row direction (R), wherein a projected length of at least one contact (12.3, 12.4) is smaller than the projected length of at least one adjacent contact (12.1, 12.2, 12.5) of the same row. Methods of using and making such modules are also provided.

9 Claims, 3 Drawing Sheets

CONTACTS OF A TELECOMMUNICATIONS MODULE WITH REDUCED CROSS-TALK

CROSS REFERENCE TO RELATED APPLICATIONS

This application is a national stage filing under 35 U.S.C. 371 of PCT/US2006/017147, filed May 3, 2006, which claims priority to European Application No. 05009690.8, filed May 3, 2005, the disclosure of which is incorporated by reference in its entirety herein.

TECHNICAL FIELD

The invention relates to a telecommunications module, a distribution point comprising at least one telecommunications module, and a method of manufacturing a telecommunications module.

BACKGROUND

In the field of telecommunications, numerous customers are connected with the switch of a telecommunications company via telecommunications lines. The customers can also be called subscribers. The switch is also called an exchange or PBX (central office exchange operated by the telecommunications company). Between the subscriber and the switch, sections of the telecommunications lines are connected with telecommunications modules. The telecommunications modules establish an electrical connection between a wire, which is attached to the telecommunications module at a first side, and another wire, which is attached to the telecommunications module at a second side. The wires of one side can also be called incoming wires and the wires of the other side can be called outgoing wires. Plural telecommunications modules can be put together at a distribution point, such as a main distribution frame, an intermediate distribution frame, an outside cabinet or a distribution point located, for example, in an office building or on a particular floor of an office building. To allow flexible wiring, some telecommunications lines are connected with first telecommunications modules in a manner to constitute a permanent connection. Flexibility is realized by so-called jumpers or cross connects, which flexibly connect contacts of the first telecommunications module with contacts of a second telecommunications module. These jumpers can be changed when a person moves within an office building to provide a different telephone (i.e. a different telephone line) with a certain telephone number, which the relocated person intends to keep. In the telecommunications module, disconnection points can be located in the electrical connection between the two sides. At such disconnection points, disconnection plugs can be inserted, in order to disconnect the line. Furthermore, protection plugs and magazines are known. These are connected to the module and protect any equipment connected to the wires from overcurrent and overvoltage. Finally, test plugs can be inserted at a disconnection point in order to test or monitor a line.

Recently, ADSL-technology has spread widely in the field of telecommunications. This technology allows at least two different signals to be transmitted on a single line. This is achieved by transmitting the different signals at different frequencies along the same line. The signals are combined at a particular point in the telecommunications line and split at another point. In particular, at the subscriber side, voice and data signals, which are separate, are combined and sent to the central office via the same line. In the central office the combined signal is split. The voice signal is then directed to the other subscriber(s) on the telephone call, and the data signal is directed to the other subscriber(s) participating in the data exchange. For the transmission of voice and data signals to the subscriber, separate voice and data signals are combined at the central office, sent to the subscriber and split at the subscriber side. After splitting the signal, the so-called POTS-signal (plain old telephone service) can be used to transmit voice signals. The remaining part of the split signal can be used to transmit data, for example. So-called splitters, which are used to split or combine the signal, can generally be arranged at any distribution point.

Any electronic components, which are necessary to perform the above functions, can be contained, possibly together with a printed circuit board as a base, in a functional module, which can be called a splitter module. Similar functional modules are protection modules, which contain any components which provide protection against overvoltage and/or overcurrent, as well as testing and monitoring modules, which contain suitable electronic components and circuits in order to test and/or monitor a telecommunications line. Furthermore, other functional modules in the above sense are known to those skilled in the art.

Recently, particularly in connection with ADSL technology, the rates at which telecommunications and data signals are transmitted by telecommunications modules have increased remarkably. In this connection, cross-talk effects have also increased. The term "cross-talk" describes an effect in which the contacts of a telecommunications module act as small antennas, which "send" a signal to adjacent contacts. This cross-talk signal interferes with the main signal(s) which is or are to be transmitted by the adjacent contacts. Generally, the signals are transmitted by a pair of wires and, therefore, by a pair of adjacent contacts. Thus, cross-talk between the contacts of a single pair is not an issue. However, cross-talk between the contacts of adjacent pairs is to be reduced as far as possible.

DE 43 25 952 C2 discloses a telecommunications module which is intended for the transmission of signals at high data rates. Contacts are arranged in two rows with a disconnection point being formed between opposing contacts. The contacts in each row are arranged in pairs as two adjacent contacts are adapted to connect two wires of a wire pair therewith in order to transmit a signal carried by the wire pair. In particular, the signal is transmitted to the opposing pair of contacts. The disconnection point between opposing contacts can be used in order to insert protection components, splitter circuits or other functional modules as described above. In the mentioned document, the distance, measured in the direction of the rows of contacts, between the contacts of one pair is smaller than the distance between two adjacent pairs.

EP 0 654 851 B1 describes a telecommunications module comprising contacts which are asymmetric. In particular, rear tabs of the contacts, which form disconnection points with the tabs of opposing contacts, are off-centered with regard to the front part of each contact, which comprises an IDC (Insulation Displacement Contacts) zone. The contacts are arranged in pairs, with the tabs of one pair being closer together than the tabs of adjacent pairs, which is realized by appropriately arranging the asymmetric contacts.

EP 0 849 841 A1 is related to a telecommunications module, in which the contacts of opposing rows are continuous without a disconnection point between them. In a rear part, the contacts are tapered so as to form increased distances between contacts of adjacent pairs, whereas the distance between the contacts of a single pair is small.

SUMMARY OF THE INVENTIONS

The invention provides a telecommunications module which demonstrates improved performance with regard to its cross-talk properties. Moreover, a distribution point comprising at least one improved telecommunications module and a method for manufacturing such a telecommunications module are provided.

The telecommunications module described herein comprises contacts which are adapted to connect wires therewith. A contact generally means any component which is adapted to establish electrical connection with at least one wire. For this purpose the contact can, for example, at a first end thereof, be formed as an IDC, a wire wrap contact or in any other suitable manner. Thus, a wire can be connected on the first end of the contact, and on a second end of the contact, an electrical connection with a further component can be established. The second end of the contact can, for example, be formed as a tab, which is in electrical connection with the tab of an opposing contact which is, at the first end thereof, substantially formed as the above first described contact. In this case, the tabs, which are in contact with each other, form a disconnection point. At this point, an outside contact of an outside module, such as a protection plug or magazine, a test plug or a splitter module can be established. The signal, which is transmitted from the wire to the contact, is further transmitted to the outside module (for example, the splitter module) and can be processed by this module. In particular, in such an application, all of the current is re-routed through the outside module. However, if the outside module is, for example, a testing device, an electrical connection forming a branch to the testing device can be established at the disconnection point, and the electrical connection between opposing contacts, which form the disconnection point, can be maintained in order to allow for a signal to be transmitted by the contact with a testing device being present at the same time. It is, however, to be emphasized that in the telecommunications module described herein, the contacts do not necessarily have to be arranged in two parallel rows so that rows of opposing contacts are formed. Rather, the contacts can also be arranged in a single row, as cross-talk can also occur in such an arrangement. Moreover, wires can be connectable at both ends of a contact. In this case, also the second end can be formed as an IDC, a wire wrap contact or in any other suitable manner, in order to allow a wire to be connected therewith. In particular, the contact as a whole can be U-shaped, and plural contacts can be arranged adjacent each other, so that the first and second ends of the contacts are arranged in two substantially parallel rows.

The telecommunications module can comprise a housing. The housing can be made of plastic or any other suitable material and can be constituted by one or more components. The housing serves to accommodate the contact elements of the telecommunications module, as detailed below. The housing can also have specific structures for positioning the contact elements therein. Moreover, the housing can comprise one or more cavities or receiving spaces, which are adapted to accommodate the contact elements and/or objects such as the functional modules described above or any other types of outside modules or parts thereof. Finally, the housing can comprise suitable structures, typically at the outside thereof, to enable the telecommunications module to be mounted to a rack or any other suitable carrier in the field of telecommunications.

In the telecommunications module described herein, the contacts are formed in a novel manner with regard to a projected length thereof. In this context, the length of the contacts generally extends substantially perpendicular to the direction of a row of contacts. The direction in which the contacts are arranged adjacent each other in a row will be referred to as the row direction. As regards the contacts, the row direction can also be called width direction, as the contacts have a certain width extending substantially in the row direction. The length direction extends substantially perpendicular thereto. Finally, a thickness direction can be described to be perpendicular to both the length and the row direction. The thickness, to which reference is made by the term "thickness direction", corresponds to the thickness of a sheet metal from which the contact can be stamped during manufacture thereof. These directions are shown in the figures, in which the row direction is denoted by R, the length direction by L and the thickness direction by T. In use, the length direction can, for example, correspond to a front-rear-direction, as the contacts can be adapted to connect wires therewith at their front end and can have a tab forming part of a disconnection point at their rear end. Because a module can be oriented in various positions, in practice the length direction can extend in a horizontal or vertical direction, or any direction in between.

In the telecommunications module described herein at least one contact has a projected length which is smaller than the projected length of at least one adjacent contact of the same row. As will be described in more detail below, overall length can be different from a projected length. In particular, the overall contact length is the overall length of a contact if any bends, curvatures or inclinations formed on the contact are straightened. The projected length is the apparent length of the contact projected onto a plane. For example, when a contact contains a bent portion, which is bent from the remainder of the contact and, therefore, deflected from the above-referenced plane, the projected length will be less than the overall length. In particular, the projected length can be different for different contacts by choosing different bending angles or different numbers of bends. In other words, the projected length is visible with a viewing direction which is parallel to the thickness direction based on those parts of the contact which are free of curvatures and/or inclinations. In a drawing the plane of the drawing will be perpendicular to the thickness direction. FIGS. 1 and 2 represent such a drawing in which the projected length, which is smaller for some contacts, can be seen.

The smaller projected length for at least one contact reduces cross-talk, because there is essentially no cross-talk effect in that part where a contact has a longer projected length than an adjacent contact. Cross-talk will normally occur between the overlapping parts of two adjacent contacts, corresponding to the projected length of the "shorter" contact, absent some additional shielding. However, cross-talk will be significantly reduced or eliminated along that part of adjacent contacts where the longer contact projects or extends beyond the shorter one. Experiments have shown that this reduces cross-talk and other interferences between adjacent contacts of different projected lengths. Thus, the performance of the telecommunications module can be improved because signals can be transmitted with a high data rate and, at the same time, an acceptable level of cross-talk. In this context, the invention provides specific advantages as it is independent from an increase of the distances in the row direction between adjacent contacts within the same row. In other words, the number of contacts in a certain row, i.e. with a given dimension of a row, does not have to be reduced. Thus, the necessary space for the telecommunications module is approximately the same as that for a standard module, which provides advantages to the customer, i.e. the provider of telecommunications services.

It can also be mentioned that the contacts can have, along their length, any suitable shape, for example asymmetric and/or tapered or the like, with preferred embodiments described below. These structures typically affect the dimensions in the row direction, and can further reduce cross-talk. This enhances the effect of the invention which is based on the reduction of the projected length of at least one contact of an adjacent pair of contacts. In particular, as compared to known solutions, which related to the distances between contacts in the row direction, the invention for the first time makes use of distances and spacings in a direction perpendicular thereto, i.e. the length direction.

In the telecommunications module described herein, at least a portion of at least one contact can be tapered along its length, typically in the length direction. Such a taper reduces the dimension of the contact in the row direction, which is the width direction of the contact. Due to the taper, there will be portions of adjacent contacts which have a distance between them which is larger than for other portions of the contacts. This further reduces cross-talk. This is related to the finding that cross-talk is dependent on the lateral distance between adjacent contacts. Thus, in the described embodiment, cross-talk can be reduced due to the reduced projected length of at least one contact in combination with the increased distance between adjacent contacts provided by tapering.

The cross-talk properties can be further improved if at least a portion of at least one contact is spaced from at least one adjacent contact in the thickness direction. In the described embodiment, the plane of a sheet metal contact would not pass directly through the remaining contacts. Rather, at least a portion of at least one contact is deflected or offset from the sheet metal plane of an adjacent contact. This deflection is represented by the spacing of at least a portion in the thickness direction. This distance or spacing further reduces cross-talk. Moreover, the total distance between adjacent contacts is further increased. This is because the total distance is not only created by a distance in the row direction (which can remain the same), but rather by the spacing in the thickness direction, which is perpendicular to the row direction, an additional component is added to the total distance, which is shown by a diagonal line in FIG. 4. In particular, the length of the diagonal line is greater than the distance between adjacent contacts in the row direction alone, as the case in conventional products of this type. Thus, cross-talk is further reduced.

In view of an efficient way to manufacture the contacts of the telecommunications module described herein, it has proven advantageous to bend at least one contact in the thickness direction. In particular, the original shape and overall length of a contact can be the same for all contacts. By bending at least one contact, and preferably both contacts of every other pair of contacts, in the thickness direction, a reduced projected length is created. This is because the contact is, at the described bending, somewhat deviated or deflected which reduces its projected length. This provides the above-described effects, which are further enhanced by the distance in the thickness direction, which is created by the bending.

Experiments have shown that cross-talk properties can be further improved if at least one contact is asymmetric with regard to an axis of symmetry extending in the length direction. In other words, at least a portion of the contact is off center with regard to the described axis of symmetry. Such an asymmetric contact is shown in FIG. 2. In particular, the off-centered portions of contacts of the same pair can be located close to each other. Correspondingly, increased distances to the contacts of adjacent pairs can be generated in the row direction. This further reduces cross-talk.

In the telecommunications module described herein, the contact can be continuous, i.e. they can provide a permanent connection without any disconnection point. However, the versatility of the telecommunications module, in particular for the interaction with outside modules as described above, can be increased when disconnection points are formed. For this purpose, the contacts can comprise a spring arm, which has been called a tab above. The spring arm is adapted to contact the spring arm of another, for example, opposing contact at a disconnection point. In this embodiment, the above-described measures for the reduction of cross-talk can particularly be realized at the spring arm. Thus, at least one contact can differ from at least one adjacent contact with regard to the structure of the spring arm.

In this context, as the projected length of at least one contact is reduced, it provides further advantages if the disconnection point of at least one contact is at a position along the length direction, which is different from the position of a disconnection point of at least one other, preferably adjacent, contact. Such a structure can be realized very efficiently, as the reduced projected length can be used to readily form the disconnection point at a position, which differs from the position (along the length direction) of an adjacent disconnection point. In particular, there can be situations where contacts of an outside module are inserted at a plurality of disconnection points between contacts of opposing rows. The separation of the disconnection points requires a certain force. This force can advantageously be reduced when disconnection points of successive contacts are located at differing locations (staggered) along the length direction, so that not all disconnection points have to be separated at the same time.

Generally, the invention is independent from any specific grouping of contacts. However, in a preferred embodiment, the contacts are arranged in pairs and the contacts of each pair are symmetrical about an axis of symmetry extending between the contacts of the pair in the length direction. In order to reduce cross-talk, the contacts of at least one pair differ from the contacts of at least one adjacent pair. This difference can be realized by one or more of the above-described features.

In this context, the telecommunications module can be kept relatively uncomplicated, when a first and a second type of pairs are alternately arranged along the row of contacts.

Thus, only two types of pairs are required, the differences between pairs can be realized in a simple and efficient manner, for example by bending the contacts of the pair that is to project a shorter distance, and the overall structure of the telecommunications module can still be kept uncomplicated.

The telecommunications module described herein can advantageously be combined with at least one outside module, such as a protection plug, a protection magazine, a test device, in particular a test plug, a monitoring device or a splitter module. In this combination additional functions can be provided by the assembly of the telecommunications module and the at least one outside module.

Generally, cross-talk is an issue with every telecommunications module. However, in order to form an entire distribution point in the field of telecommunications module, which allows the transmission of signals with high data rates and with reduced cross-talk, a distribution point comprising at least one telecommunications module in one or more of the above-described embodiments, is to be considered subject matter of the invention. The distribution point can, for example, be a main distribution frame.

In the novel method of manufacturing a telecommunications module having contacts to connect wires therewith, the contacts are arranged in at least one row. The contacts have a length extending in the length direction. In order to provide a telecommunications module with improved cross-talk properties, the projected length of at least one contact is less than the projected length of at least one adjacent contact of the same row. Preferred embodiments of the method correspond to preferred embodiments of the telecommunications module to be produced by the method as described above.

DESCRIPTION OF THE DRAWINGS

Hereinafter the invention will be described by non-limiting examples thereof with reference to the drawings, in which.

DESCRIPTION OF A PREFERRED EMBODIMENT OF THE INVENTION

Figure 1:
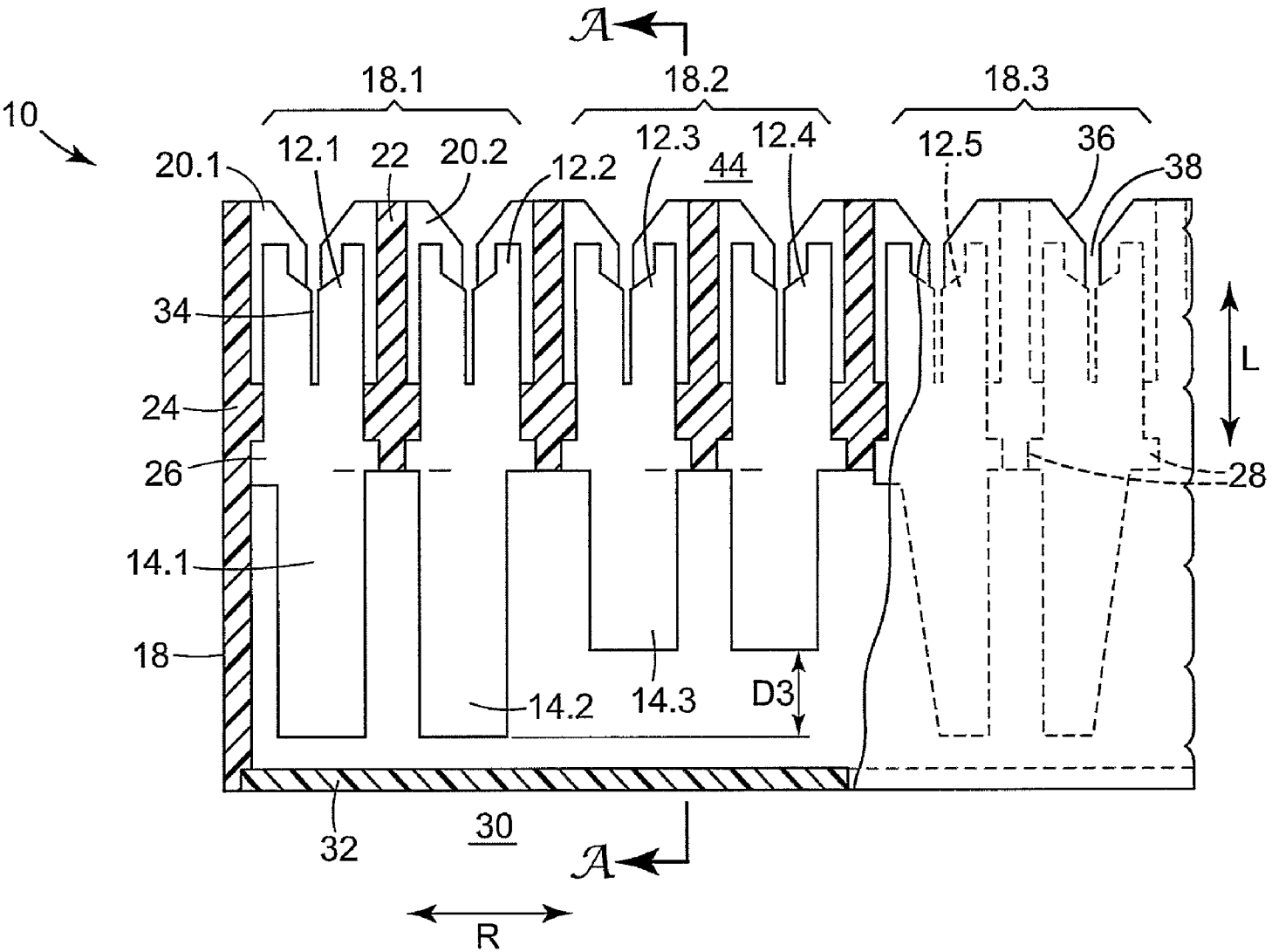
FIG. 1 shows a sectional view of a part of a first embodiment of a telecommunications module, with the section taken along the row direction.

FIG. 1 shows a plan view of a part of the telecommunications module 10. The view is a cut view with a section taken along the row direction R, i.e. the direction in which a row of contacts 12 extends. In the embodiment shown, the telecommunications module 10 comprises a housing 18, in which plural cavities, compartments or chambers 20 are defined with partitions 22 between them. In the embodiment shown, each chamber 20 is adapted to accommodate two opposing contacts with only one of them being visible in FIG. 1. The contacts 12 are positioned within the housing 18. In the embodiment shown, the housing comprises projections 24 extending into each chamber 20 in order to define a step or stop 26 for positioning the contact. For this purpose, as can be seen most clearly in the right part of FIG. 1, the contacts also comprise projections 28 which interact with the stops 26 to define the position of the contacts in the length direction L thereof. Moreover, the projections 28 are adapted to fit into suitable indentations formed in the housing so as to position the contacts also in the row direction R. This is further supported by the fact that the width of the contacts, extending in the row direction R, substantially correspond to the interior width of those portions of the housing, where the contacts are accommodated.

In particular, in the embodiment shown, the contacts 12 can, during the manufacture of the module, be inserted into the housing 18 of the telecommunications module 10 from a rear side 30 thereof, until the projections 28 abut the stops 26 of the housing 18. In the embodiment shown, a cover 32, closing the housing 18 at the rear side 30 thereof, can be mounted after all contacts 12 have been inserted. In the embodiment shown, the contacts 12 have a substantially uniform width which extends in the row direction R, with the exception of projections 28. Projections 28 could instead be indentations, with corresponding structure provided within the housing to retain the contacts in position, or any combination of cooperating structures that serve the same purpose.

At a front side 44 thereof, the contacts 12 of the embodiment shown each comprise an IDC zone with a slit 34. A wire (not shown) having insulation can be inserted from the front side 44 and the edges bordering the slit 34 can cut the insulation and contact the metal core of the wire to conduct electrical signals between the wire and the contact. In the embodiment shown, the contacts 12 comprise a funnel-shape structure in an area in front of the slit 34. Moreover, a similar, V-shaped entrance area 36 (see the right side of FIG. 1) is formed in the housing 18. The adjacent slit 38 formed in the housing 18 is, in the embodiment shown, somewhat wider than the slit 34 of the contact 12 and can, thus, be used to clamp the wire (not shown) including its insulation so as to resist any pulling forces which might act on a wire. The relative dimensions of the slit 38 and the slit 34 can be designed to accommodate the particular size(s) of wire expected.

In the contacts 12 the projections 28 can be formed in a center portion thereof along the length of the contacts. In a rear portion the contacts comprise spring arms 14 which are formed in a manner to reduce cross-talk. The contacts 12 are arranged in pairs with, for the part shown in FIG. 1, contacts 12.1 and 12.2 constituting a first pair 18.1, and contacts 12.3 and 12.4 constituting a second pair 18.2. The effect of reducing cross-talk is obtained by forming the contacts 12.3 and 12.4 of pair 18.2 with a shorter projected length than the contacts 12.1, 12.2 of pair 18.1. Thus, a distance D3 exists as shown in FIG. 1. In particular, the contacts 12.1 and 12.2 of the first pair 18.1 extend beyond the contacts 12.3, 12.4 of the second pair 18.2. In that part where the contacts of the first pair 18.1 are longer, less or perhaps no cross-talk will occur and the cross-talk properties as a whole can be improved. As indicated for the next pair of contacts 18.3 along the row, this pair can be formed identical to the first pair 18.1 and alternating types of pairs of contacts can thereafter generally be formed in the row direction R.

Figure 2:
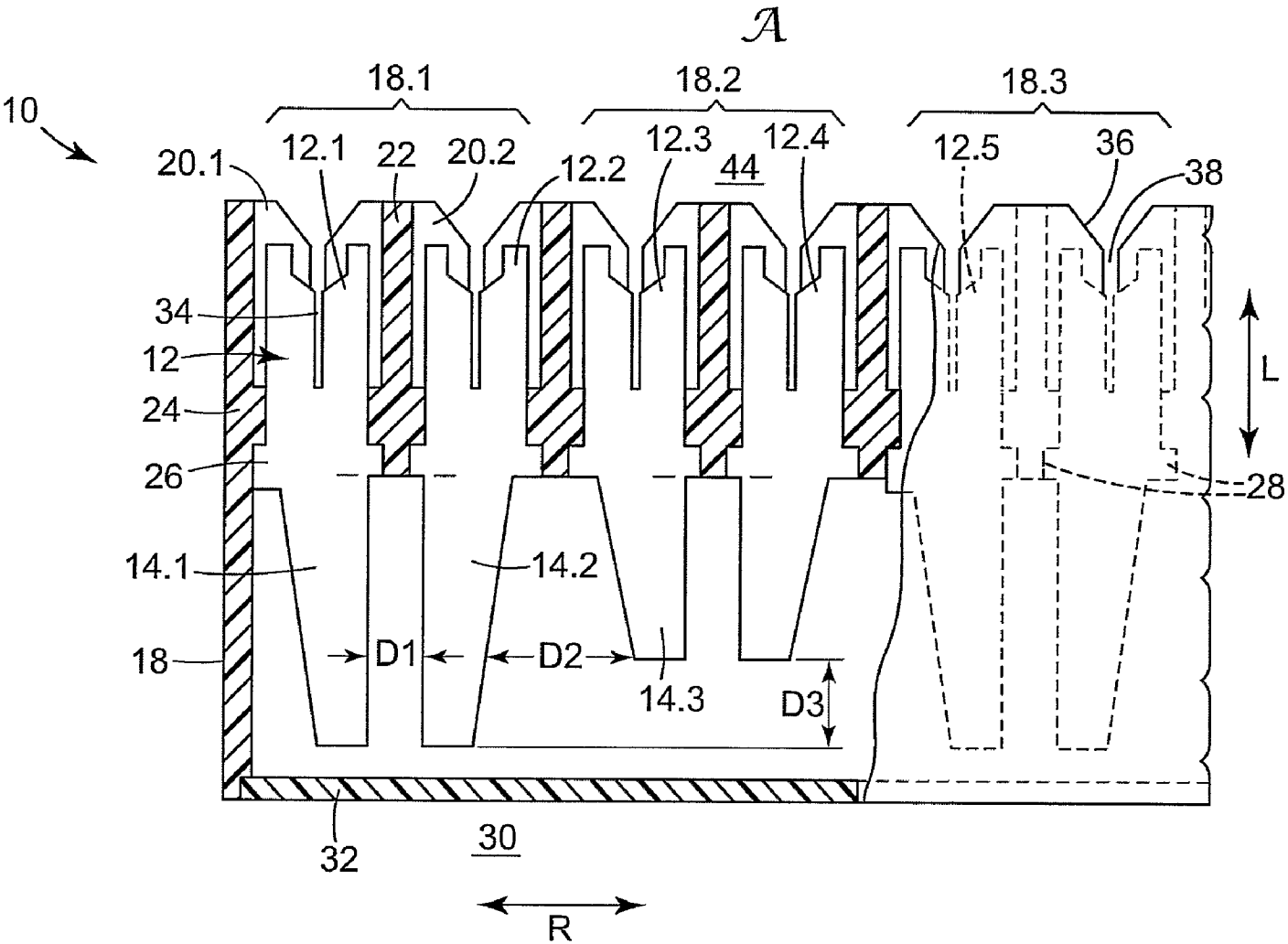
FIG. 2 shows a sectional view of a part of a second embodiment of a telecommunications module, with the section taken along the row direction.

FIG. 2 shows a second embodiment of a telecommunications module in which merely the spring arms 14 are different from those of the embodiment of FIG. 1. Since all remaining portions are unchanged, their repeated description will be omitted. However, the spring arms 14 are formed in a manner to further reduce cross-talk. For this purpose, the spring arms are off-center so as to give the contacts 12 a shape, which is asymmetric with regard to an axis of symmetry extending in the length direction L through their slit 34.

In particular, the spring arm of each contact is off-center. Moreover, in the embodiment shown, the spring arms 14 are tapered in the length direction L so that their width, measured in the row direction R, reduces towards the rear 30. Tapered spring arms are an optional, but desirable feature. The asymmetric contacts are arranged in such a way that the spring arms 14.1, 14.2 of one pair 18.1 are spaced for a distance D1, which is smaller than a distance D2 between spring arms 14.2 and 14.3 which belong to contacts of different pairs. Thus, as cross-talk can occur between contacts of different pairs, this increased distance D2 will reduce cross-talk. The above-described measures in connection with distance D3 which is described in detail above and created by the difference in the projected length, will reduce cross-talk to an acceptable level.

Figure 3:
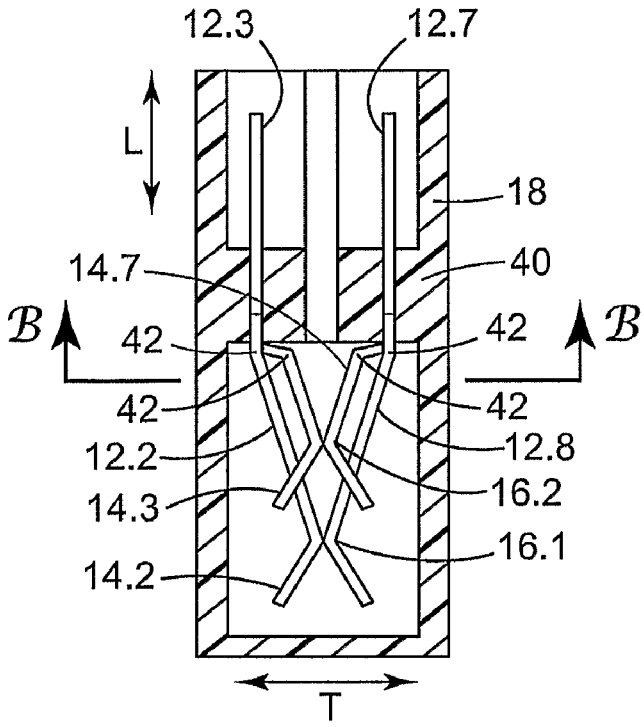
FIG. 3 shows a sectional view of the telecommunications module of FIG. 2 with the section taken along line A-A in FIG. 2.

FIG. 3 shows a sectional view along line A-A in FIG. 2. In particular, it can be seen that the embodiment shown comprises opposing rows of contacts, with one contact having a shorter projected length 12.3 and 12.7, respectively, being visible in each row. Those contacts 12.3, 12.7 are closer to the observer than the contacts 12.2, 12.8 having a longer projected length behind them. The rows of contacts are substantially symmetrical about a plane which extends vertically and perpendicular to the plane of the drawing of FIG. 3. In particular, in a rear part of the module, the spring arms 14 of the contacts 12 are in contact with each other at disconnection points 16 in order to form a disconnectable electrical connection. This disconnection point can, for example, be used to insert contacts of outside modules in order to connect these with opposing contacts.

In FIG. 3, contact 12.3 and opposing contact 12.7 project a lesser distance in the length direction L than contacts 12.2 and 12.8 of the adjacent pair 18.1 (see FIG. 1). Moreover, disconnection point 16.2 between the contacts 12.3 and 12.7 projecting a lesser distance is at a different position along the length direction than disconnection point 16.1 between contacts 12.2 and opposing contact 12.8. In other words, based on the orientation of FIG. 3, disconnection points 16.1 and 16.2 are on different levels. In the embodiment shown, cross-talk can additionally be reduced by the spacing between adjacent contacts 12.2, 12.3 as well as 12.7, 12.8 in the thickness direction T thereof. This spacing is produced, in the case shown, by bending the shorter contacts 12.3, 12.7 at a location 42 just to the rear of the center web 40 of the housing 18. In the embodiment shown, two opposite curvatures of approximately 60 degrees are formed so as to bring the spring arms 14.3, 14.7 in a position substantially parallel to the spring arms 12.2, 12.8, however, spaced apart in the thickness direction T. This further reduces the cross-talk in addition to the fact that D2 is greater than D1 (see FIG. 2) and an overlap between adjacent contacts along distance D3 is avoided (see FIGS. 1 and 2). In the embodiment shown in the drawings, also the overall length of the contacts, i.e. before forming the curvatures, differs between the contacts of adjacent pairs. However, a shorter projected length, i.e. a distance D3, can also be generated, if identical contacts having the same overall length are subjected to the curvatures as shown in FIG. 3. This will reduce the projected length of the bent contacts and will, moreover, create a distance in the thickness direction T. The combination of these effects is believed to reduce cross-talk.

Figure 4:
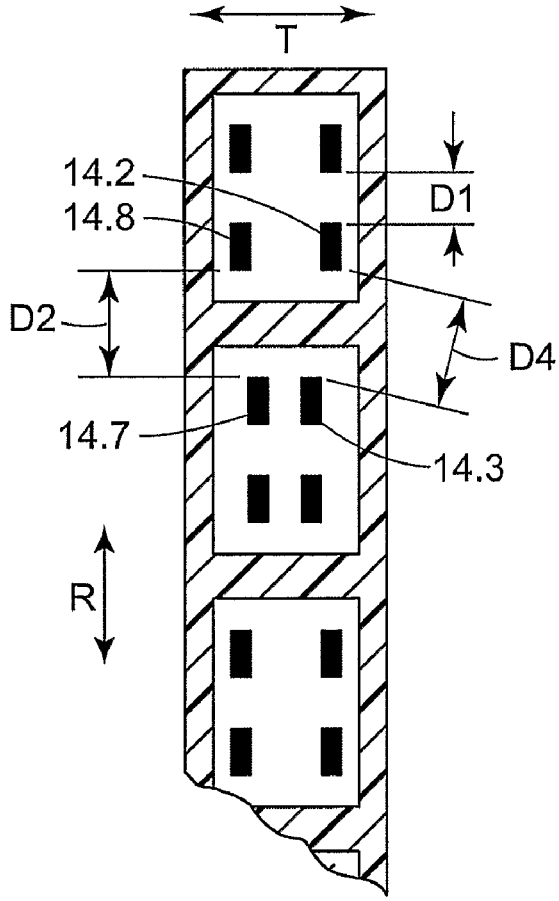
FIG. 4 shows a further sectional view of the telecommunications module of FIGS. 2 and 3, with the section taken along line B-B in FIG. 3.

FIG. 4 shows the combined effect which can be called the "diagonal effect". Firstly, it should again be noted that distance D2 between the contacts of adjacent pairs is greater than distance D1 between the contacts of one pair. However, the distance D2 is measured in the row direction R alone. The total distance D4 between the contacts of adjacent pairs is determined not only by distance D2, but also by any additional distance measured in the thickness direction T. Due to the bending, the spring arms 14.3 and 14.7 are offset in the thickness direction T with regard to the adjacent spring arms 14.2, 14.8, so that the total distance D4 is greater than distance D2 measured in the row direction R alone and the cross-talk properties can be further improved.

The present invention has now been described with reference to several embodiments thereof. The foregoing detailed description and embodiment have been given for clarity of understanding only. No unnecessary limitations are to be understood therefrom. For example, all references to front and rear, or row, width, length or thickness directions are exemplary only and do not limit the claimed invention. It will be apparent to those skilled in the art that many changes can be made to the embodiment described without departing from the scope of the invention. Thus, the scope of the present invention should not be limited to the exact details and structures described herein, but rather by the structures described by the language of the claims, and the equivalents of those structures.

The invention claimed is:

1. A telecommunications module, comprising contacts adapted to connect wires therewith and arranged in at least one row defining a row direction, the contacts having a length direction extending substantially perpendicular to the row direction, wherein a projected length of at least one contact is smaller than the projected length of at least one adjacent contact of the same row, wherein at least a plurality of the contacts comprise a spring arm adapted to contact the spring arm of another contact at a disconnection point, and wherein at least one contact differs from at least one adjacent contact with regard to the structure of the spring arm.

2. The telecommunications module in accordance with claim 1 wherein at least a portion of at least one contact is tapered in the length direction.

3. The telecommunications module in accordance with claim 1 wherein at least a portion of at least one contact is spaced from at least one adjacent contact in a thickness direction substantially perpendicular to both the length direction and the row direction.

4. The telecommunications module in accordance with claim 3 wherein at least one contact is bent at an angle at at least one location along the length thereof in the thickness direction.

5. The telecommunications module in accordance with claim 1 wherein at least one contact is asymmetric with regard to an axis of symmetry extending in the length direction.

6. The telecommunications module in accordance with claim 1 wherein the disconnection point of at least one contact is at a position along the length thereof that is different from the position of a disconnection point of at least one other contact.

7. The telecommunications module in accordance with claim 1 wherein at least a plurality of the contacts are arranged in pairs, the contacts of each pair being symmetrical about an axis of symmetry extending between the contacts of the pair in the length direction and the contacts of at least one pair differing from the contacts of at least one adjacent pair.

8. The telecommunications module in accordance with claim 7 wherein a first and a second type of pairs are arranged alternately along the row of contacts.

9. A distribution point in the field of telecommunications comprising at least one telecommunications module in accordance with claim 1.

* * * * *